US009206760B2

(12) United States Patent
Mitsuyasu et al.

(10) Patent No.: US 9,206,760 B2
(45) Date of Patent: Dec. 8, 2015

(54) VEHICLE CONTROL DEVICE

(75) Inventors: Masaki Mitsuyasu, Kawasaki (JP); Norimi Asahara, Numadu (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 217 days.

(21) Appl. No.: 13/991,711

(22) PCT Filed: Dec. 7, 2010

(86) PCT No.: PCT/JP2010/071927

§ 371 (c)(1),
(2), (4) Date: Jun. 5, 2013

(87) PCT Pub. No.: WO2012/077188

PCT Pub. Date: Jun. 14, 2012

(65) Prior Publication Data

US 2013/0253805 A1 Sep. 26, 2013

(51) Int. Cl.
*F02D 41/30* (2006.01)
*F02D 41/12* (2006.01)

(52) U.S. Cl.
CPC ..... *F02D 41/3005* (2013.01); *F02D 41/126* (2013.01)

(58) Field of Classification Search
CPC ... F02D 41/3005; F02D 41/30; F02D 41/123; F02D 41/126; F02D 41/10; F02D 41/12
USPC ..... 701/101–104, 110–112; 123/198 DB, 123/325, 406.42, 406.45, 406.47, 492, 493, 123/339.11; 477/8
See application file for complete search history.

(56) References Cited

U.S. PATENT DOCUMENTS

| | | | | |
|---|---|---|---|---|
| 8,251,042 | B2 * | 8/2012 | Ito | 123/339.11 |
| 2003/0028295 | A1 | 2/2003 | Wakashiro et al. | |
| 2004/0231640 | A1 | 11/2004 | Iwasaki et al. | |
| 2004/0250792 | A1 | 12/2004 | Mizobuchi et al. | |
| 2010/0175663 | A1 | 7/2010 | Ito | |
| 2011/0245034 | A1 * | 10/2011 | Yoshida et al. | 477/8 |

FOREIGN PATENT DOCUMENTS

| | | | |
|---|---|---|---|
| CN | 1400119 | A | 3/2003 |
| CN | 1432725 | A | 7/2003 |
| JP | A-2001-263096 | | 9/2001 |
| JP | A-2003-41959 | | 2/2003 |
| JP | A-2003-65124 | | 3/2003 |
| JP | A-2005-2920 | | 1/2005 |

(Continued)

*Primary Examiner* — Stephen K Cronin
*Assistant Examiner* — Xiao Mo
(74) *Attorney, Agent, or Firm* — Oliff PLC

(57) ABSTRACT

When a state in which fuel supply to a combustion chamber of an internal combustion engine is cut is recovered, since a vehicle control device starts the fuel supply by controlling the internal combustion engine at the time that a requested driving force that is being requested becomes the same as an actual driving force that is being actually generated, the vehicle control device can appropriately start the fuel supply when the fuel cut state is recovered. When, for example, the deviation between the requested driving force and the actual driving force becomes within a preset and predetermined range, as the time at which the requested driving force that is being requested becomes the same as the actual driving force that is being actually generated, the vehicle control device starts the fuel supply.

4 Claims, 3 Drawing Sheets

(56) References Cited

FOREIGN PATENT DOCUMENTS

| | | | | | |
|---|---|---|---|---|---|
| JP | A-2008-231985 | | 10/2008 | | |
| JP | 2010084611 | A * | 4/2010 | | |
| JP | A-2010-84611 | | 4/2010 | | |
| WO | WO 2008114118 | A2 * | 9/2008 | ..... | F02D 41/12 |

* cited by examiner

VEHICLE CONTROL DEVICE

FIELD

The present invention relates to a vehicle control device.

BACKGROUND

As a conventional vehicle control device, Patent Literature 1, for example, discloses an engine control device for determining a fuel cut recovery time until fuel supply is recovered as a delay time based on an accelerator opening degree when the state in which the fuel supply to a combustion chamber of an engine is cut is recovered.

CITATION LIST

Patent Literature

Patent Literature 1: Japanese Patent Application Laid-open No. 2010-084611

SUMMARY

Technical Problem

Incidentally, the engine control device described in Patent Literature 1 described above has a room for a further improvement in the point of, for example, more appropriate recovery from a fuel cut state.

An object of the present invention, which was made in view of the circumstances described above, is to provide a vehicle control device capable of appropriately starting fuel supply when a fuel cut state is recovered.

Solution to Problem

In order to achieve the above mentioned object, in a control device for a vehicle according to the present invention having an internal combustion engine, and a combustion chamber that is provided in the internal combustion engine and to which an air and a fuel are supplied, when a state in which fuel supply to the combustion chamber of the internal combustion engine is cut is recovered, the control device starts the fuel supply by controlling the internal combustion engine at the time that a requested driving force that is being requested becomes the same as an intake pipe pressure estimated driving force that is estimated from an intake pipe pressure of the internal combustion engine and generated at the time of recovery from a fuel cut.

Further, in the control device for a vehicle, it is possible to configure that the control device starts the fuel supply at the time that the deviation between the requested driving force and the intake pipe pressure estimated driving force becomes within a preset and predetermined range.

Further, in the control device for a vehicle, it is possible to configure that in a state in which the fuel supply is cut, the control device increases an opening degree of an intake path to the combustion chamber as compared with a state in which the fuel supply is not cut.

Advantageous Effects of Invention

The vehicle control system and the vehicle control device according to the present invention achieve an effect that fuel supply can be appropriately started when a fuel cut state is recovered.

DESCRIPTION OF EMBODIMENTS

An embodiment according to the present invention will be explained below in detail based on drawings. Note that the present invention is not limited by the embodiment. Further, components in the embodiment include the components that can be replaced by a person skilled in the art and are easy or include substantially the same components.

Embodiment

Figure 1:
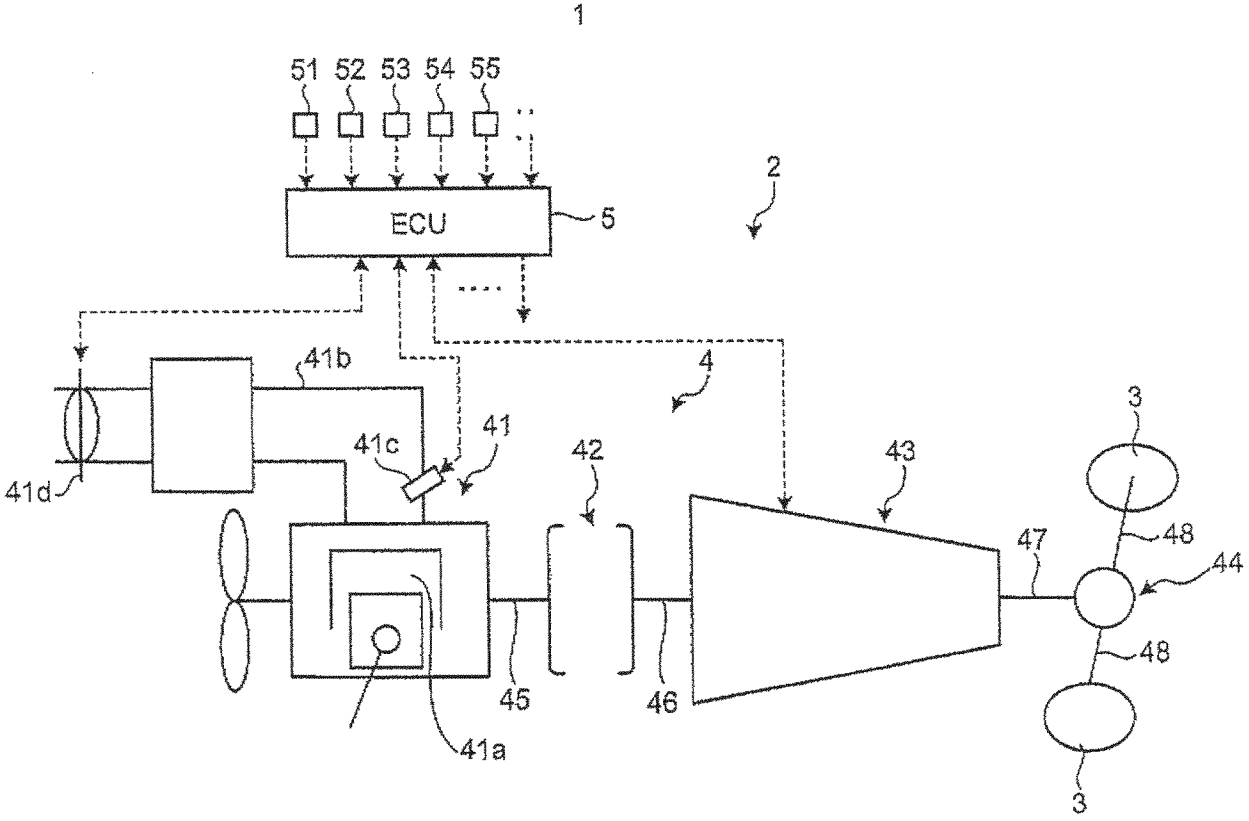
FIG. 1 is a schematic arrangement view of a vehicle to which a vehicle control system according to an embodiment is applied.
Figure 2:
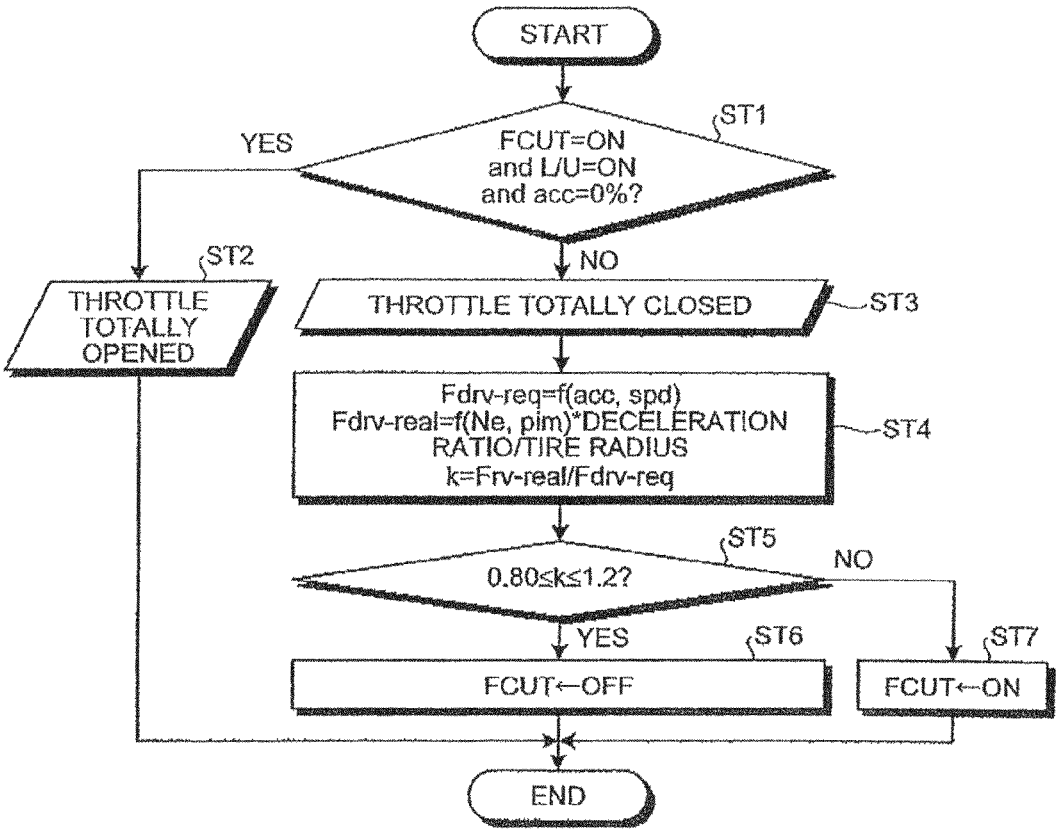
FIG. 2 is a flowchart explaining an example of control executed by an ECU.
Figure 3:
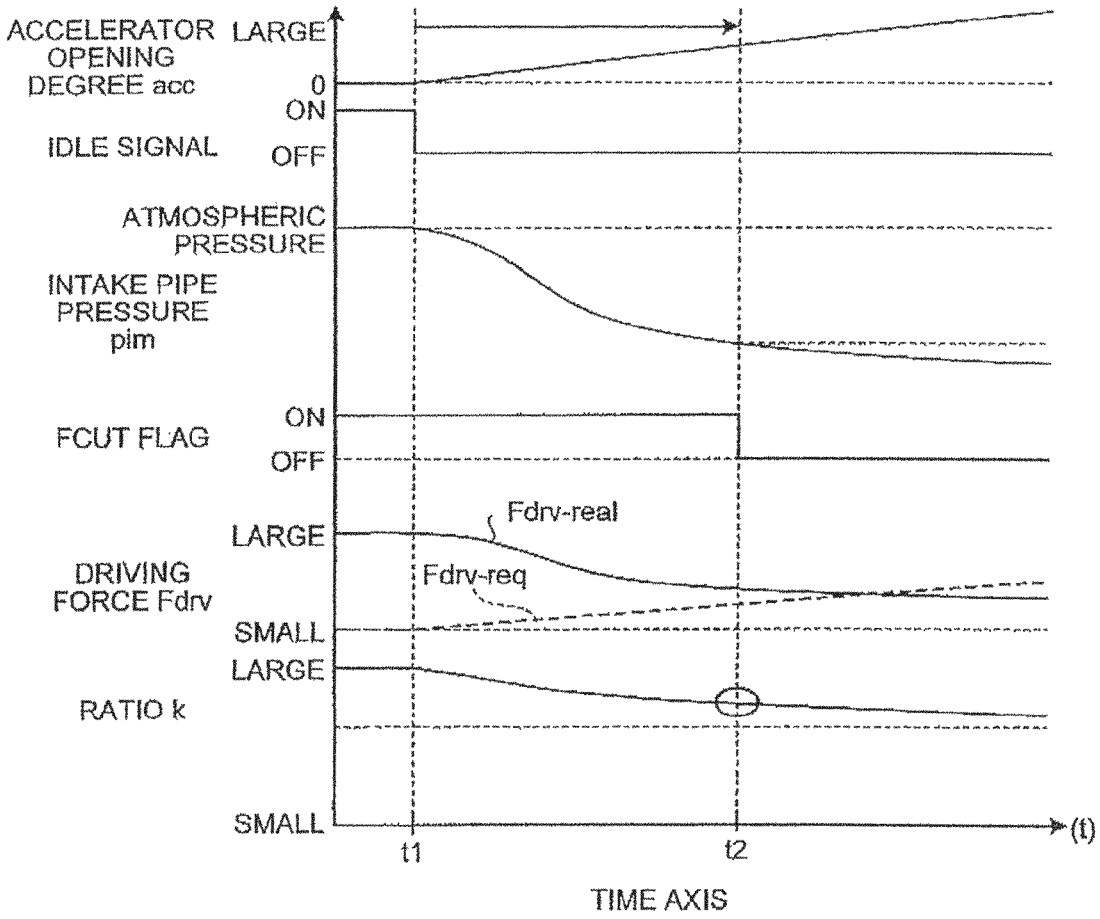
FIG. 3 is a time chart explaining an example of the control executed by the ECU.

FIG. 1 is a schematic arrangement view of a vehicle to which a vehicle control system according to an embodiment is applied, FIG. 2 is a flowchart explaining an example of control executed by an ECU, and FIG. 3 is a time chart explaining an example of the control executed by the ECU.

As illustrated in FIG. 1, a vehicle control system 1 of the embodiment is a system mounted on a vehicle 2 for controlling the vehicle 2. In the vehicle control system 1, an ECU 5 executes fuel cut control for cutting fuel supply to a combustion, chamber 41*a* of an engine 41 while the vehicle 2 is travelling.

Specifically, as illustrated in FIG. 1, the vehicle control system 1 includes driving wheels 3, a driving device 4, and the ECU 5 as a vehicle control device. Note that the vehicle control device explained below will be explained assuming that the vehicle control device is composed of the ECU 5 for controlling respective portions of the vehicle 2, the vehicle control device is not limited thereto and the vehicle control device and the ECU 5 may be separately configured.

The driving device 4 has the engine 41 as an internal combustion 'engine and drives' the driving wheels 3 in rotation by the engine 41. More specifically, the driving device 4 is configured including the engine 41, a torque converter 42, a transmission 43, a differential gear 44, and the like. In the driving device 4, a crank shaft 45 as an internal combustion engine output shaft of the engine 41 is connected to a transmission input shaft 46 of the transmission 43 via the torque converter 42, and a transmission output shaft 47 of the transmission 43 is connected to the driving wheels 3 via the differential gear 44, drive shafts 48, and the like.

The engine 41 is a travelling power source (prime mover) for causing the vehicle 2 to travel and generates a power to be applied to the driving wheels 3 of the vehicle 2 by consuming fuel. The engine 41 is a heat engine for converting the energy of fuel to a mechanical work and outputs the mechanical work by combusting the air sacked into the combustion chamber 41*a* via an intake path 41*b* such as an intake pipe, an intake port, and the like and the fuel supplied from a fuel injection valve 41*c* in the combustion chamber 41*a*. The engine 41 can adjust a throttle opening degree corresponding to the opening degree of the intake path 41*b* by opening and closing a throttle valve 41*d* disposed to the intake path 41*b* and can adjust the amount of air sucked into the combustion chamber 41*a*. In the engine 41, the respective portions such as the fuel injection valve 41*c*, the throttle valve 41*d*, and the like are controlled by the ECU 5. Note that the engine 41 illustrated in FIG. 1 is illustrated assuming that it is of a so-called port injection type for injecting fuel to an intake port that constitutes the intake path 41*b*, the engine 41 may be of a so-called direct injection type that directly injects fuel into the combustion chamber 41*a*.

When a lock-up clutch is turned OFF (lock-up OFF), the torque converter 42 transmits the power from the crank shaft 45 of the engine 41 to the transmission input shaft 46 of the transmission 43 by amplifying the torque by a fluid transmitting unit. When the lock-up clutch is turned ON (lock-up ON), the torque converter 42 transmits the power from the crank shaft 45 of the engine 41 to the transmission input shaft 46 of the transmission 43 via the lock-up clutch, keeping the torque thereof as it is. The transmission 43 changes the rotating power (rotating output) from the engine 41 that has been input to the transmission input shaft 46 at a predetermined transmission gear ratio and transmits the power to the transmission output shaft 47. Respective portions of the torque converter 42, the transmission 43, and the like are controlled by the ECU 5 via a hydraulic pressure control device. The differential gear 44 transmits the power transmitted to the transmission output shaft 47 to the driving wheels 3 via the drive shafts 48. Note that the transmission 43 can use transmissions having various known configurations, for example, a stepped automatic transmission (AT), a continuously variable automatic transmission (CVT), a multi-mode manual transmission (MMT), a sequential manual transmission (SMT), a dual clutch transmission (DCT), and the like and may be also a so-called manual transmission (MT).

The ECU 5 controls the drive of respective portions of the vehicle 2 and is an electronic circuit mainly composed of a known microcomputer including a CPU, ROM, RAM, and an interface. The ECU 5 is input with electric signals corresponding to results of detection from various sensors such as an accelerator opening degree sensor 51 for detecting an accelerator opening degree corresponding to the operation amount of an accelerator pedal, a throttle opening degree sensor 52 for detecting a throttle opening degree, a vehicle speed sensor 53 for detecting a vehicle speed that is a travelling speed of the vehicle 2, an engine revolution speed sensor 54 for detecting an engine revolution speed that is the rotation number of the crank shaft 45 of the engine 41, an intake air pressure sensor 55 for detecting an intake pipe pressure that is a pressure in an intake pipe that constitutes the intake path 41*b*, and the like. The ECU 5 controls the engine 41, the torque converter 42, the transmission 43, and the like according to the input results of detection, obtained information, and the like. The ECU 5 can detect whether an accelerator operation, which is an acceleration request operation to the vehicle 2 executed by a driver, is turned ON or OFF based on, for example, the result of detection detected by the accelerator opening degree sensor 51.

The vehicle control system 1 configured as described above can transmit the power generated by the engine 41 to the driving wheels 3 via the torque converter 42, the transmission 43, the differential gear 44, and the like, with a result that the vehicle 2 generates a driving force [N] between the ground contact surface of the driving wheels 3 and a road surface and can travel by the driving force [N].

At the time of, for example, ordinary driving, the ECU 5 adjusts the intake air amount to the engine 41 by adjusting the throttle opening degree based on an accelerator opening degree, a vehicle speed, and the like, controls a fuel injection amount corresponding to the change of the intake air amount, and executes the output control of the engine 41 by adjusting the amount of air-fuel mixture filled in the combustion chamber 41*a*. Further, the ECU 5 executes the gear shift control of the transmission 43 based on the accelerator opening degree, the vehicle speed, and the like.

While the vehicle 2 is travelling, the ECU 5 controls the fuel injection valve 41*c* under a predetermined condition end executes fuel cut control for cutting the fuel supply to the combustion chamber 41*a* of the engine 41. When, for example, the accelerator opening degree detected by the accelerator opening degree sensor 51 is equal to or less than a predetermined value, the ECU executes the fuel cut control. With the operation, the vehicle control system 1 can improve fuel consumption by suppressing consumption of unnecessary fuel.

Further, while fuel is being cut, that is, when the fuel supply to the combustion chamber 41*a* is cut, the ECU 5 may execute control for increasing the throttle opening degree corresponding to the opening degree of the intake path 41*b* to the combustion chamber 41*a* by controlling the throttle valve 41*d* as compared with the case that the fuel supply is not cut. With the operation, while the vehicle 2 is being decelerated and fuel is being cut, the vehicle control system 1 can reduce a pumping loss by opening the throttle valve 41*d*, can generate an appropriate engine brake force, and can reduce a torque shock caused by the shift-down of the transmission 43.

When the ECU 5 of the embodiment recovers from the state in which the fuel supply to the combustion chamber 41*a* of the engine 41 is cut, the ECU 5 can appropriately start the fuel supply when the ECU recovers from the fuel cut state by starting the fuel supply by controlling the fuel injection valve 41*c* of the engine 41 at the time that a requested driving force that is being requested becomes the same as an actual driving force that is being actually generated. That is, the ECU 5 realizes appropriate recovery from the fuel cut by recovering from the fuel cut state when the requested driving force approaches the actual driving force.

The ECU 5 typically calculates the requested driving force [Fdrv−req] that is a driving force requested by the driver based on an accelerator opening degree relating value and a vehicle speed relating value. An accelerator opening degree [acc], a throttle opening degree [ta], and the like, for example, can be used as the accelerator opening degree relating value. A vehicle speed [spd], an engine revolution speed [Ne], the output rotation number (rotation number of the transmission output; shaft 47) [No] of the transmission 43, and the like, for example, can be used as the vehicle speed relating value. Here, the ECU 5 calculates the requested driving force [Fdrv−req] based on, for example, the accelerator opening degree [acc] detected by the accelerator opening degree sensor 51 and the vehicle speed [spd] detected by the vehicle speed sensor 53 ([Fdrv−req]=f(Acc, spd)).

The ECU 5 calculates the actual driving force [Fdrv—real] that is a driving force that is actually generated typically based on an intake pipe pressure relating value, an engine revolution speed relating value, and the integral deceleration ratio γ in a power transmission system of the transmission 43, the differential gear 44, and the like. An intake pipe pressure [Pim], an air flow meter [am], and the like, for example can be used as the intake pipe pressure relating value. The engine revolution speed [Ne], the vehicle speed [spd], the output rotation number [No] of the transmission 43, and the like can be used as the engine revolution speed relating value. The deceleration, ratio γ is determined according to, for example, the deceleration ratio of the transmission 43, the differential ratio of the differential gear 44, and the like. Here, the ECU 5 calculates the actual driving force [Fdrv−real] based on, for example, the intake pipe pressure [Pim] detected by the intake air pressure sensor 55, the engine revolution speed [Ne]

detected by the engine revolution speed sensor 54, the deceleration ratio γ, and the tire radius of the driving wheels 3 ([Fdrv−real]=f(Pim, Ne, γ)).

The ECU 5 determines whether or not the deviation between the requested driving force [Fdrv−req] and the actual driving force [Fdrv−real] becomes within a preset and predetermined range as to determine whether or not the requested driving force [Fdrv−req] becomes the same as the actual driving force [Fdrv−real]. When the deviation between the requested driving force [Fdrv−req] and the actual driving force [Fdrv−real] becomes within the preset and predetermined range, the ECU 5 controls the fuel injection valve 41*c* and starts the fuel supply assuming that the requested driving force [Fdrv−req] becomes the same as the actual driving force [Fdrv−real].

More specifically, the ECU 5 calculates a ratio [k] by calculating, for example, [Fdrv−real]/[Fdrv−req] as the deviation between the requested driving force [Fdrv−req] and the actual driving force [Fdrv−real] (k=[Fdrv−real]/[Fdrv−req]). When the ratio [k] becomes within a preset and predetermined range, i.e., satisfies, for example, $0.80 \leq k \leq 1.2$, the ECU 5 determines that the requested driving force [Fdrv−req] becomes the same as the actual driving force [Fdrv−real], starts the fuel supply, and recovers from the fuel cut state.

When the vehicle control system 1 configured as described above recovers from the state in which the fuel supply to the combustion chamber 41*a* is cut, the ECU 5 can start the fuel supply by controlling the fuel injection valve 41*c* at the time that the requested driving force [Fdrv−req] becomes the same as the actual driving force [Fdrv−real] regardless of, for example, a time passed from the time at which the driver turned ON the accelerator operation (delay time), and the like. Accordingly, when the ECU 5 recovers from the state in which the fuel supply to the combustion chamber 41*a* is cut, since the ECU 5 starts the fuel supply by controlling the fuel injection valve 41*c* at the time that the requested driving force [Fdrv−req] becomes the same as the actual driving force [Fdrv−real], the ECU 5 can appropriately start the fuel supply when it recovers from the fuel cut state.

That is, since the difference between the driving force requested by the driver and the driving force generated at the time that of recovery from the fuel cut state is reduced because the ECU 5 recovers from the fuel cut state when the requested driving force [Fdrv−req] approaches the actual driving force [Fdrv−real], a recovery shock felt by the driver at the time of recovery from the fuel cut can be reduced. Further, when the ECU 5 recovers from the state in which the fuel supply to the combustion chamber 41*a* is cut, the ECU 5 can recover from the fuel cut state with better responsiveness as compared with a technology for providing a predetermined delay time until the fuel supply is recovered, and the like and can appropriately reduce the recovery shock at the time of recovery from the fuel cut according to an actual engine torque (intake pipe pressure, throttle opening degree, engine revolution speed), the deceleration ratio of the power transmission system, and the like. Further, to say in more detail, the ECU 5 can start the fuel supply at an optimum timing to every acceleration state from gentle acceleration to abrupt acceleration of the vehicle 2 and can appropriately suppress the recovery shock to the every acceleration state.

When, for example, the vehicle 2 is gently accelerated at a relatively small acceleration, since the requested driving force [Fdrv−req] is slowly increased, the ECU 5 starts the fuel supply after the actual driving force [Fdrv−real] has been reduced to the vicinity of the requested driving force [Fdrv−req] and has been sufficiently stabilised at a low level. As a result, since the vehicle 2 generates a small torque according to the recovery shock after torque has been reduced up to a relative small value at the beginning of acceleration, the vehicle 2 can cause the recovery shock to be less felt by the driver.

Further, when, for example, the vehicle 2 is abruptly accelerated in a relatively large acceleration, since the requested driving force [Fdrv−req] is promptly increased, the ECU 5 starts the fuel supply at a relatively early stage at the time that the actual driving force [Fdrv−real] is large to some extent. As a result, in the vehicle 2, since a large torque according to the recovery shock is generated succeeding to the generation of a relatively large torque at the beginning of acceleration, it is possible to cause the recovery shock to be less felt, by the driver.

As a result, at the time of acceleration of the vehicle 2, since the ECU 5 can reduce a feeling error of an actually generated torque to an accelerator operation feeling of the driver when the state in which the fuel supply to the combustion chamber 41*a* is cut is recovered, the ECU 5 can simultaneously realize, for example, the suppression of hesitation at the time of gentle acceleration of the vehicle 2 and the suppression of shock at the time of abrupt acceleration of the vehicle 2. Further, since the ECU 5 can start the fuel supply at optimum timing to every acceleration state from the gentle acceleration to the abrupt acceleration of the vehicle 2 without determining whether the acceleration is, for example, gentle or abrupt, adaptation man-hour, for example, can be reduced.

In particular, when the ECU 5 executes the control for relatively increasing the throttle opening degree while fuel is being cut, the intake pipe pressure Pim becomes the atmospheric pressure by opening the throttle valve 41*d*, thereby a lot of air is caused to exist in the intake path 41*b* of the engine 41, although the pumping loss can be reduced. Accordingly, even if the ECU 5 executes control for reducing the throttle opening degree to generate the requested driving force requested by the driver at the time of recovery from the fuel cut state, the engine 41 is placed in the state in which a lot of air is supplied into the combustion chamber 41*a*. When the engine 41 resumes the fuel supply to the combustion chamber 41*a* in the state in which the lot of air is supplied to the combustion chamber 41*a* as described above, there is a possibility that the engine 41 generates the actual driving force equal to or more than the requested driving force, thereby there is a possibility that the recovery shock becomes serious. However, since the ECU 5 of the embodiment starts the fuel supply by controlling the fuel injection valve 41*c* when the requested driving force [Fdrv−req] becomes the same as the actual driving force [Fdrv−real] at the time of recovery from the fuel cut state, even when, for example, the ECU 5 executes the control for relatively increasing the throttle opening degree while fuel is being cut, the ECU 5 can appropriately reduce the shock generated at the time of recovery from the fuel cut after the pumping loss has been reduced.

Next, an example of the control executed by the ECU 5 will be explained referring to a flowchart of FIG. 2. Note that the routine of the control is repeatedly executed at a control cycle of several milliseconds to several tens of milliseconds.

First, as a determination at the time of deceleration fuel cut, the ECU 5 determines whether or not an FCUT flag is turned ON (FCUT flag=ON), the lock-up clutch of the torque converter 42 is turned ON (L/U=ON), and the accelerator opening degree [acc] is 0% (acc=0%) at the time in the fuel cut state based on the results of detection of the various sensors, the operating state of the torque converter 42, and the like (ST1). The ECU 5 determines whether or not FCUT flag=ON, L/U=ON, and acc=0% based on the results of detection of the various sensors, for example, the accelerator opening degree sensor 51, and the like, the operating state of the torque converter 42, and the like.

When the ECU 5 determines that FCUT flag=ON, L/U=ON, and acc−0% (ST1: Yes), the ECU 5 totally opens the throttle opening degree [ta] or keeps the throttle opening degree [ta] in the totally open state by controlling the throttle valve 41*d* as throttle totally opening control at the time of F/C (ST2), finishes the control cycle at the time, and goes to a next control cycle. When the ECU 5 determines that FCUT flag=OFF, L/U=OFF or acc≠0% (ST1: No), the ECU 5 totally closes the throttle opening degree [ta] or keeps the throttle opening degree [ta] in the totally closed state by controlling the throttle valve 41*d* (ST3) as throttle totally closing control at the time of recovery from F/C.

Next, the ECU 5 calculates the requested driving force [Fdrv−req] and the actual driving force [Fdrv−real] and calculates the ratio [k] as ratio calculation control (ST4). The ECU 5 calculates the requested driving force [Fdrv−req] from a map, and the like based on, for example, the accelerator opening degree [acc] detected by the accelerator opening degree sensor 51 and the vehicle speed [spd] detected by the vehicle speed sensor 53 ([Fdrv−req]=f(Acc, spd)). The ECU 5 calculates the actual driving force [Fdrv−real] based on, for example, the intake pipe pressure [Pim] detected by the intake air pressure sensor 55, the engine revolution speed [Ne] detect by the engine revolution speed sensor 54, the deceleration ratio γ, and the tire radius of the driving wheels 3 ([Fdrv−real]=f(Pim, Ne)×deceleration ratio γ/tire radius). The actual driving force [Fdrv−real] corresponds to an intake pipe pressure estimated driving force [Fdrv−pim] estimated from the intake pipe pressure [Pim]. The ECU 5 calculates the ratio [k] by calculating, for example, [Fdrv−real]/[Fdrv−req] (k=[Fdrv−real]/[Fdrv−req]).

Next, the ECU 5 determines whether or not the ratio [k] calculated at ST4 is within the range equal to or more than 0.80 to equal to or leas than 1.2 (ST5) as ratio range determination control. When the ECU 5 determines that the ratio [k] is within the range equal to or more than 0.80 to equal to or less than 1.2 (ST5: Yes), the ECU 5 turns OFF the FCUT flag (FCUT←OFF) as recovery control from fuel cut, starts the fuel supply by controlling the fuel injection valve 41*c* (ST6), finishes the control cycle at the time, and goes to the next control cycle. When the ECU 5 determines that the ratio [k] is out of the range equal to or more than 0.80 to equal to or less than 1.2 (ST5: NO), the ECU 5 turns ON the FCUT flag (FCUT←ON) as fuel cut continuation control, continues to cut the fuel supply (ST7), finishes the control cycle at the time, and goes to the next control cycle.

Next, an example of the control executed by the ECU 5 will be explained referring to a time chart of FIG. 3. In FIG. 3, a horizontal axis is a time axis and a vertical axis illustrates an accelerator opening degree [acc], an idle signal, an intake pipe pressure [Pim], an FCUT flag, a driving force [Fdrv], and a ratio [k].

In the example, in the period before a time t1 at which the accelerator opening degree [acc] is 0%, the vehicle 2 is in such a state that the FCUT flag is turned ON, the idle signal is turned ON, the intake pipe pressure [Pim] becomes approximately the atmospheric pressure, and the fuel supply to the combustion chamber 41*a* is cut.

In the vehicle 2, when the accelerator operation is turned ON and the accelerator opening degree [ace] is increased at the time t1, the idle signal is turned OFF by the ECU 5. Then, in the vehicle 2, as the intake pipe pressure [Pim] is reduced, the actual driving force [Fdrv−real] is reduced. In contrast, in the vehicle 2, as the accelerator opening degree [acc] is increased, the requested driving force [Fdrv−req] is increased, and the ratio [k] is reduced.

Then, in the vehicle 2, when the ratio [k] becomes within the range equal to or more than 0.80 to equal to or less than 1.2 at a time t2, the FCUT flag is turned OFF by the ECU 5 and the fuel supply to the combustion chamber 41*a* is started.

According to the ECU 5 according to the embodiment explained above, when the state in which the fuel supply to the combustion chamber 41*a* of the engine 41 is cut is recovered, the fuel supply is started by controlling the engine 41 at the tints that the requested driving force that is being requested becomes the same as the actual driving force that is being actually generated. Accordingly, when the fuel cut state is recovered, the ECU 5 can appropriately start the fuel supply and can reduce the recovery shock when, for example, the fuel cut state is recovered.

Note that the vehicle control device according to the embodiment of the present invention described above is not restricted to the embodiment described above and can be variously changed within the scope described in claims.

The vehicle explained above may be a so-called "hybrid vehicle" provided with a motor generator and the like as an electric motor capable of generating electric power in addition to the engine 41 as a travelling driving source and may be also a so-called "free-run S & S (stop & start) vehicle" capable of stopping and restarting the engine 41 under a predetermined condition while travelling.

INDUSTRIAL APPLICABILITY

As described above, the vehicle control device according to the present invention is preferably applied to a vehicle control device mounted on various vehicles.

REFERENCE SIGNS LIST

1 VEHICLE CONTROL SYSTEM
2 VEHICLE
3 DRIVING WHEEL
4 DRIVING DEVICE
5 ECU (VEHICLE CONTROL DEVICE)
41 ENGINE (INTERNAL COMBUSTION ENGINE)
41*a* COMBUSTION CHAMBER
41*b* INTAKE PATH
41*c* FUEL INJECTION VALVE
41*d* THROTTLE VALVE
51 ACCELERATOR OPENING DEGREE SENSOR
52 THROTTLE OPENING DEGREE SENSOR
53 VEHICLE SPEED SENSOR
54 ENGINE REVOLUTION SPEED SENSOR
55 INTAKE AIR PRESSURE SENSOR

The invention claimed is:

1. A control device for a vehicle, the vehicle having an internal combustion engine, and a combustion chamber provided in the internal combustion engine, the combustion chamber being supplied with air and fuel, the control device comprising:

an electronic control unit programmed to start fuel supply, the electronic control unit being programmed to start the fuel supply when a state, in which the fuel supply to the combustion chamber of the internal combustion engine is cut, is recovered, by controlling the internal combustion engine at a time a requested driving force being requested becomes the same as an intake pipe pressure estimated driving force, the intake pipe pressure estimated driving force being: (i) estimated from an intake pipe pressure of the internal combustion engine, and (ii) generated at a time of recovery from the fuel cut.

2. The control device for a vehicle according to claim 1, wherein the electronic control unit is programmed to start the fuel supply at a time that a deviation between the requested driving force and the intake pipe pressure estimated driving force becomes within a predetermined range.

3. The control device for a vehicle according to claim 1, wherein, in the state in which the fuel supply is cut, the electronic control unit is programmed to increase an opening degree of an intake path to the combustion chamber as compared with a state in which the fuel supply is not cut.

4. The control device for a vehicle according to claim 2, wherein, in the state in which the fuel supply is cut, the electronic control unit is programmed to increase an opening degree of an intake path to the combustion chamber as compared with a state in which the fuel supply is not cut.

* * * * *